US005093076A

United States Patent [19]

Young et al.

[11] Patent Number: 5,093,076

[45] Date of Patent: Mar. 3, 1992

[54] HOT PRESSED MAGNETS IN OPEN AIR PRESSES

[75] Inventors: Kevin A. Young, Fairmount; Joseph J. Worden, Anderson; Donald S. Kirk, Fishers; Larry J. Eshelman, Pendleton, all of Ind.

[73] Assignee: General Motors Corporation, Detroit, Mich.

[21] Appl. No.: 700,743

[22] Filed: May 15, 1991

[51] Int. Cl.[5] ..... B22F 1/00

[52] U.S. Cl. ..... 419/12; 419/38; 419/57; 419/66; 419/48; 148/101; 148/105

[58] Field of Search ..... 419/12, 38, 48, 57, 419/66; 148/101, 105

[56] References Cited

U.S. PATENT DOCUMENTS

| | | | |
|---|---|---|---|
| 4,710,239 | 12/1987 | Lee et al. | 148/101 |
| 4,780,226 | 10/1988 | Sheets et al. | 252/28 |
| 4,792,367 | 12/1988 | Lee | 148/104 |
| 4,802,931 | 2/1989 | Croat | 148/302 |
| 4,842,656 | 6/1989 | Maines et al. | 148/302 |
| 4,844,754 | 7/1989 | Lee | 148/302 |
| 4,851,058 | 7/1989 | Croat | 148/302 |
| 4,881,985 | 11/1989 | Brewer et al. | 148/103 |
| 4,902,361 | 2/1990 | Lee et al. | 148/302 |
| 4,920,009 | 4/1990 | Lee et al. | 428/552 |
| 4,963,320 | 10/1990 | Saito et al. | 419/12 |
| 4,978,398 | 12/1990 | Iwasaki et al. | 148/101 |
| 4,985,086 | 1/1991 | Iwasaki et al. | 148/101 |
| 4,995,905 | 2/1991 | Sagawa | 75/244 |
| 5,004,499 | 4/1991 | Ghandehari | 75/254 |
| 5,009,706 | 4/1991 | Sakamoto et al. | 75/244 |
| 5,049,203 | 9/1991 | Mukai et al. | 148/101 |
| 5,049,208 | 9/1991 | Yajima et al. | 148/302 |

*Primary Examiner*—Stephen J. Lechert, Jr.
*Assistant Examiner*—N. Bhat
*Attorney, Agent, or Firm*—George A. Grove

[57] ABSTRACT

This invention describes a practice for the hot pressing and/or hot working of rare earth element-containing alloy powders using open-to-the-air presses. The rare earth-containing powder is pressed into a compact at ambient temperatures using a solid lubricant only on the die wall. This compact is then hot pressed in an open air press utilizing a heated die flooded with argon.

6 Claims, 4 Drawing Sheets

HOT PRESSED MAGNETS IN OPEN AIR PRESSES

This invention pertains to practices for the hot pressing and subsequent hot working of rare earth element-containing powder alloys. More particularly, this invention pertains to the hot pressing of such materials using open air presses.

BACKGROUND OF THE INVENTION

Rare earth element-containing alloys composed so as to form the $RE_2TM_{14}B$ tetragonal crystal phase have been melt spun under carefully controlled processing to produce useful permanent magnet materials as disclosed in Croat U.S. Pat. No. 4,802,931 and U.S. Pat. No. 4,851,058. Such melt-spun materials either as quenched or in an overquenched and annealed condition consist essentially and predominantly of the tetragonal crystal, prototype $Nd_2Fe_{14}B$ phase. The tetragonal crystal-containing grains are very small, typically less than a few hundred nanometers on the average in grain size, and are surrounded by one or more secondary grain boundary phases which contribute to the permanent magnet characteristics of the composition. This fine grain material is magnetically isotropic, and the melt-spun ribbon fragments can be pulverized to a suitable powder, combined with a suitable binder material and molded into useful bonded permanent magnets as disclosed in Lee et. al. U.S. Pat. No. 4,902,361.

Where permanent magnets of higher energy product are desired, it is known that the melt-spun powder material can be hot pressed to form a fully densified permanent magnet body and that, where desired, such fully densified body can be further hot work deformed. These practices are disclosed, for example, in Lee U.S. Pat. No. 4,792,367 and 4,844,754.

The fine grained, melt-spun, rare earth element-containing material is initially in the form of ribbon particles or a powder produced by comminution of the ribbon fragments. In order to hot press or otherwise hot work the material, it is necessary that it be heated to a suitable hot working temperature typically in the range of 700° C. to 800° C. As disclosed by Lee, it is prudent to heat the powder in vacuum or suitable inert gas that provides a dry and substantially oxygen-free environment in order to prevent the powder from burning. In attempting to work with such readily oxidizable rare earth element-containing materials, it has been necessary to provide a suitable protective atmosphere in which the rare earth and other constituents are not oxidized and the permanent magnetic properties of the materials are not degraded.

In powder metallurgy practices, it is known to produce a compact by pressing suitably ductile powder particles together at ambient conditions. This can be done (and is done with larger grain size rare earth element-transition metal-boron, RE-TM-B, materials in sintering processes) to produce a partly densified, porous body in air at room temperature. However, if such a $Nd_2Fe_{14}B$ compact is heated preparatory to hot working, it must be protected from oxidation in order to avoid degradation of the permanent magnet properties. Obviously, it is possible to enclose the operative portion of a press in such a non-oxidizing atmosphere, but it is expensive and impractical to adapt such apparatus for high speed production if accurate powder feeding, powder heating, compaction and hot working are to be carried out entirely within such a special atmosphere chamber. Such a press would be very expensive to construct and operate and cumbersome to operate and maintain.

Accordingly, it is necessary to develop a practice for hot pressing and, optionally, the additional hot work deformation of such rare earth element-containing powder alloy materials so that the rapid and efficient production of permanent magnets can be accomplished. It is a general object of this invention to provide a method for hot pressing and additional hot work processing of RE-TM-B type powder materials on relatively inexpensive open air-type presses in a way that provides a suitable protection from oxidation or burning.

BRIEF SUMMARY OF THE INVENTION

In accordance with preferred embodiments of our invention, the above and other objects are accomplished as follows.

The starting material for the practice of our invention is a melt-spun ribbon particle or powder composition composed so as to ultimately form a magnet body consisting essentially of the tetragonal phase $RE_2TM_{14}B$ and a minor portion of a grain boundary phase(s) of higher rare earth element content. While RE stands for rare earth elements generally, it is preferred that the rare earth constituent of this material be made up of at least 60 percent of neodymium and/or praseodymium. The transition metal element (TM) is preferably iron or mixtures of iron with cobalt and/or with minor portions of other metals. This rapidly solidified starting material will preferably be of very fine grain size (e.g., less than 50 nm) or almost amorphous. The hot pressing process and any additional hot working process will then densify and work the material and simultaneously effect a growth in grain size such that the average grain size is larger but still less than about 500 nm in largest dimension. The product has useful permanent magnet properties.

The practices of our invention are suitably carried out in an open air press of the type having a die(s) with a die wall defining a die cavity of suitable cross-sectional configuration. In such presses, the workpiece material or body is inserted in the die cavity and compacted or worked by opposing machine members, typically lower and upper punches. Frequently the opposing press members are upper and lower punches and the die is of uniform cross section throughout its length. Sometimes the dies contain steps or shelves and the punch(es) is (are) configured accordingly. Sometimes a punch is cored. Sometimes a punch is replaced with a flat anvil surface. Our invention may be practiced with all such press arrangements.

Referring to the operation of a conventional two-punch press with uniform die cavity, the upper punch is initially raised out of the die cavity and the lower punch is initially in a low position so as to open the cavity to receive the material to be worked. The upper punch is then lowered to close the cavity, and the two punches are then mechanically or hydraulically actuated so as to press and compact the workpiece material between them. The punches closely fit the die wall so as to confine the material being worked but are slightly spaced from the die wall so as to reduce friction and wear. After the material is compacted, the upper punch is raised out of the cavity and the lower punch is raised so as to elevate the compacted workpiece above the top edge of the die or so that the worked piece can be removed. This process is repeated on a continuous basis.

In accordance with our invention, we produce a hot pressed, fully densified, permanent magnet body in two pressing steps.

Powder material of an above-described composition, in an amount based on the dimensions of the desired workpiece, is first compacted to a green compact at ambient temperature and in air. This pressing can be called cold pressing. The cold pressed compact suitably has a density of about five grams per cubic centimeter or higher, preferably about 5.3 to 5.5 grams per cubic centimeter. We form such a compact, in part, to somewhat reduce the particle surface exposed to oxidation and to improve heat transfer to the mass.

In this cold pressing operation, we form a film of a solid die lubricant, such as Teflon powder, on the die wall of the press. No lubricant or binder is mixed with the rare earth element-containing powder because the material is quite reactive and chemical change degrades magnetic properties.

The Teflon or like lubricant is preferably applied in the form of a liquid suspension of powder in a nonflammable, highly volatile liquid vehicle that helps to disperse the powder. In this regard, we prefer the use of a liquid comprising a suitable fluorocarbon(s). The fluid Teflon-containing mixture is preferably applied to the die cavity wall through suitable small holes in a punch, e.g., the lower punch, after the previously formed compact has been ejected from the die and the punch is being moved to its lowest position to receive the next charge of melt-spun powder. The upper punch is actuated to cold press the powder against the lower punch into a porous green compact. The dried die wall lubricant film facilitates the compaction and the removal of the compact in one piece from the die. This process can usually be repeated every one to six seconds or so depending upon the size of the compact to be formed and the complexity of its shape.

After the green compact has been formed, it is then ready to be hot worked in another open air press. Usually, a different press is employed because it is adapted to heat the tools and the workpiece to facilitate the hot pressing operation and requires heat-resistant tooling materials. In the operation of this hot press, we coordinate the movement of the punches with the introduction of a dry inert gas such as dry argon into the die cavity. Starting with the upper punch raised above the die cavity and the lower punch in its uppermost position for ejecting a previously hot pressed workpiece, we commence flooding the die cavity with dry argon. A preferred mechanical arrangement for this practice will be described in detail below. As the lower punch is dropped to a position for receiving a cold pressed workpiece, argon flooding continues so as to fill the enlarged cavity to purge it of air.

The die itself is preferably maintained at a temperature suitable for heating the workpiece and carrying out the hot working operation, e.g., 870° C. The workpiece is dropped into the hot, relatively massive hot die cavity, and it lands on the hot lower punch. The upper punch is lowered, and the punches are then loaded so as to exert compaction pressure on the workpiece. The consolidated workpiece is almost instantaneously heated to a temperature (700° C. to 800° C.) that permits it to be rapidly pressed into a fully dense magnet body. After pressing, the upper punch is raised clear of the die cavity, and the lower punch is raised to eject the hot pressed magnet from the die cavity. The fully dense body is cooled in the normal atmosphere. The process can then be repeated every 25 to 90 seconds or so, depending upon the size of the workpiece and the like.

The hot worked body upon cooling is useful as is as a substantially isotropic permanent magnet. The hot working produces a suitable grain size for permanent magnet properties. In the event an anisotropic permanent magnet is required, the hot pressed body may be further hot worked to deform it into a body in which the small 2-14-1 grains are flattened and aligned. For example, this operation can be carried out in a larger hot die, i.e., the known process of die upsetting, using an open air hot press and practice. The resulting die upset body upon cooling has a preferred direction of magnetization parallel to the direction of pressing and is an extremely strong permanent magnet. Both the hot pressing operation described above and this die upsetting operation yield permanent magnet bodies that require little further finishing operations.

Other objects and advantages of our invention will become apparent from a detailed description thereof in which reference will be had to the drawings.

DETAILED DESCRIPTION

As summarized above, the process of our invention involves two compaction steps for the manufacture of a fully densified magnet body and a third manufacturing step where additional hot working or hot deformation of the fully densified body is required in order to produce a more fully anisotropic magnet with stronger permanent magnet properties. The first two steps of our process are compacting or pressing steps, and they can be carried out on conventional presses for this purpose. Indeed, an advantage of our invention is that both compaction steps can be carried out on open-to-the-air presses.

During our description of the process, we will refer to the drawings in which only a small portion of the press is depicted, namely that depicting the die and the upper and lower punches because it is in this region of the press that the special features of our process are involved. We illustrate a preferred embodiment of our invention in the making of a sensor magnet in the shape of a circular right cylinder. However, it is to be understood that other magnet shapes can be produced by changing the die cross-section and punch shape. It is also to be understood that other press tooling constructions may be employed such as one punch anvil pressing, the pressing of ring shapes requiring cores, and the pressing of assemblies, i.e., magnets onto rotors or shunts, and the use of die shapes like shelf dies and step dies.

Figure 1B:
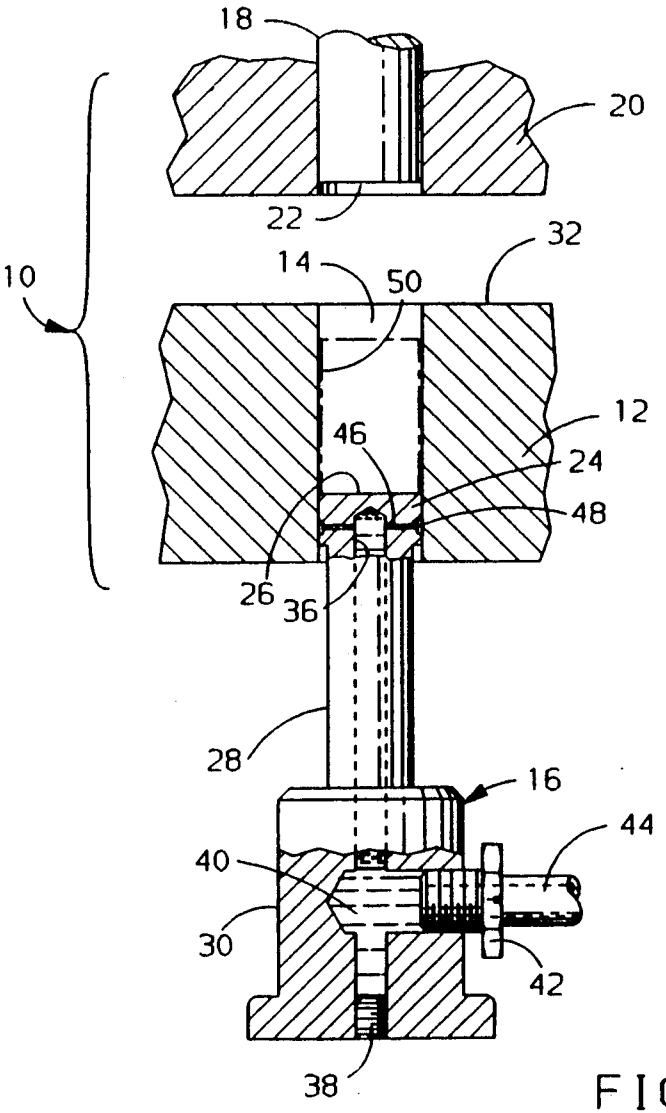
FIGS. 1*a* through 1*d* are schematic views, partly in section, of a cold forming, open air press illustrating the sequence of cold compact forming steps, including lubrication of the die cavity wall by spraying through the lower punch.
Figure 1A:
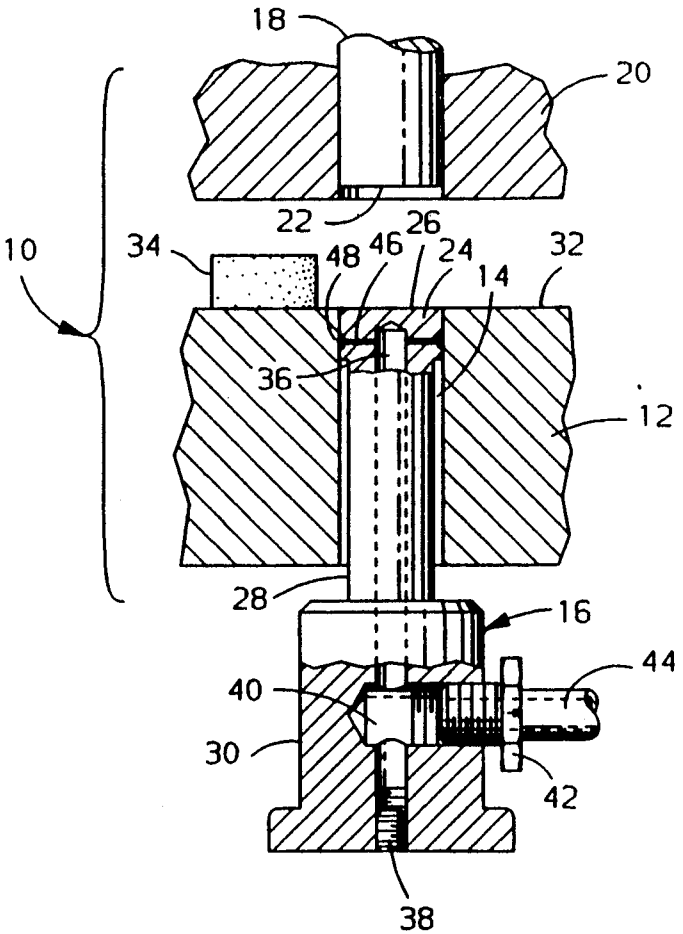

FIGS. 1*a* through 1*d* thus depict a small portion only of an open-to-the-air operable-at-ambient-condition cold press 10. Cold press 10 has a die member 12 with a round cylindrical die cavity 14. Reciprocably operative in the die cavity 14 is a lower punch assembly 16. Also reciprocably operable in the die cavity is an upper punch 18. Upper punch 18 is slidably retained and guided by upper punch carrier 20. Upper punch 18 has a round, flat punch face 22. As shown in FIGS. 1*a* and 1*b*, upper punch 18 has been raised to its uppermost position to facilitate removal of a compacted product from the die of the cold press and the addition of a new particulate starting material.

Lower punch 16 comprises a head 24, with a flat face 26, that is circular in cross section and adapted to closely fit the wall of die cavity 14. The lower punch 16 comprises a smaller diameter shank portion 28. Lower punch 16 also includes an enlarged base 30 that is below the die block 12. As shown in FIG. 1*a*, the lower punch is elevated to its uppermost position with face 26 just flush with the upper surface 32 of die block 12. In this position, the lower punch has raised a just-formed cold compacted body of RE-TM-B particles 34. This cold compact 34 is being moved aside by a rake or other mechanical means (not shown) at the end of the compaction cycle of the press operation.

A typical such cold compact is a still slightly porous green compact of RE-TM-B particles of the type described above. It has a density in excess of 5 grams per cubic centimeter and is very useful in accordance with our process for the hot pressing and, if necessary, further hot working of this compact into a fully densified magnet body with exceptionally good permanent magnet properties.

Following the ejection of the cold compact body 34, lower punch 16 is then lowered to its lowest position (as shown in FIG. 1*b*) in the operation of the press. It is during this lowering process that this lower punch carries out an important part of the practice of our invention. Formed in lower punch 16 is a central axial hole 36 that extends from the base 30 of the punch 16 the length of the shank 28 of the punch and into the head 24. Axial hole 36 can be formed by drilling the hole through the base 30 up through the shank 28 into the head 24 and then closing off the outlet in the base with plug member 38. Plug member 38 is preferably flush with the bottom of the base member 30 so that the mechanically actuated press can operate on the bottom of the base to raise and lower the lower punch 16.

A transverse hole 40 is provided in the base member 30 that intersects axial hole 36. Hole 40 is threaded to receive fitting 42 and a supply tube 44 that is used for purposes that will soon be described. A small diameter second transverse hole 46 with respect to axial hole 36 is drilled in the head 24 of the punch. Small hole or duct 46 extends diametrically across the head 24 of the punch and with outlets in a machined annular ring 48 that is parallel to the face 26 of the punch but slightly below it at the upper end of axial passage 36. Thus, lower punch 16 contains a continuous internal passage leading from tube 44 into cross duct 40 through axial duct 36 to the small outlet duct 46 in the head 24 of the punch. The purpose of this passage is to supply a suitable lubricant to the wall surface of die cavity 14.

The selection of the lubricant system in the practice of our invention is important. The lubricant is not mixed with the rapidly solidified particles that are to be consolidated into a green compact in this step of the invention. The rare earth element constituent of the composition is reactive and susceptible to degradation by residual lubricant material, particularly during storage and/or hot pressing of the compact. The lubricant is applied to the die wall through the ductwork described above in the lower punch. We prefer the use of a solid lubricant. The solid lubricant preferably is Teflon particles. The Teflon particles are applied by the use of a liquid carrier or vehicle. The mixture is suitably about 90 percent by volume liquid vehicle and 10 percent by volume Teflon particles. The liquid is a material that can suspend the Teflon particles if the mixture is agitated and carry them through the tube and ductwork of the lower punch. The vehicle must also be a material that is nonflammable and will readily vaporize from the wall of the die.

A suitable vehicle for use in our invention is a fully fluorinated derivative of an aliphatic hydrocarbon, preferably a hydrocarbon of 2 to 8 carbon atoms in the molecule. A perfluorinated hexane or octane is suitable. These molecules may be in the form of either molecular chains or cyclo compounds. We prefer to use perfluorinated hexane. Such materials are able to suspend the lubricant powder and are nonreactive with the rare earth element containing compact.

Thus, a mixture of about 90 percent by volume liquid fluorocarbon and 10 percent by volume Teflon powder is mixed and prepared in a separate container not shown in the drawings. The mixture is agitated and then delivered from the container through tube 44 and ducts 40, 36 and 46 to the die cavity wall 14 of die 12. The container or delivery system not shown is adapted to supply the fluid under pressure as required.

Referring now to FIGS. 1*a* and 1*b*, the lubricant mixture is pressurized at the time that the lower punch is at its uppermost point as depicted in FIG. 1*a*. As the lower punch is lowered in the die cavity until it reaches its position in FIG. 1*b*, pressure is applied to the fluid and a coating film 50 of the fluid is applied to the cavity wall 14 of the die as depicted in FIG. 1*b*. The vehicle vaporizes very rapidly although there is a residual amount. Another important feature of our invention requiring the use of the perfluorinated compound is the fact that this material, if it remains on the surface of the cold compact, does not adversely affect the permanent magnet properties of the body during any storage or hot pressing.

Figure 1D:
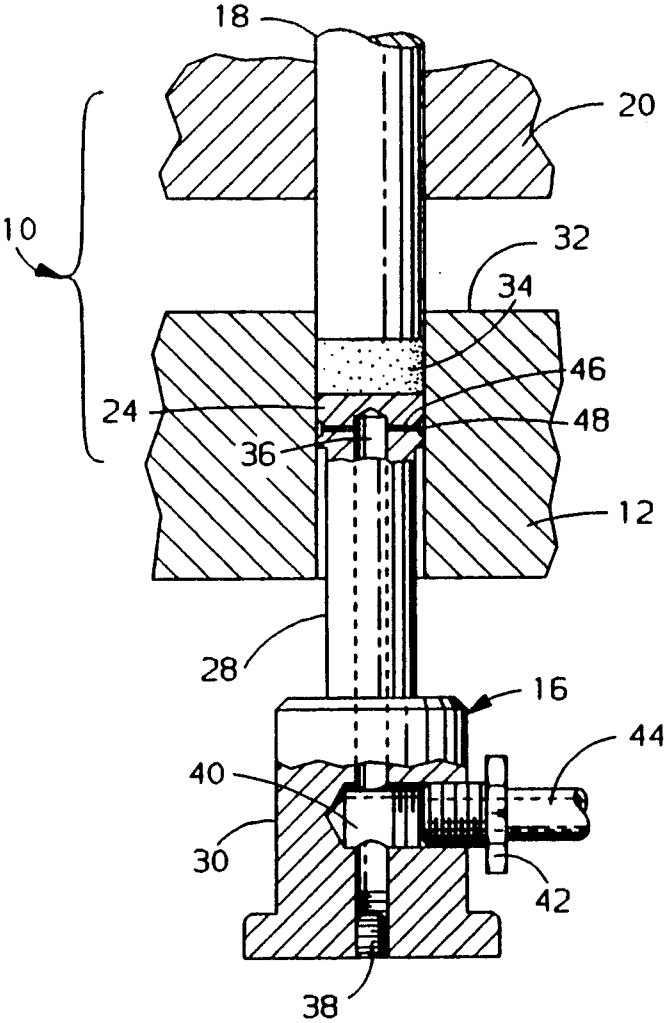
Figure 1C:
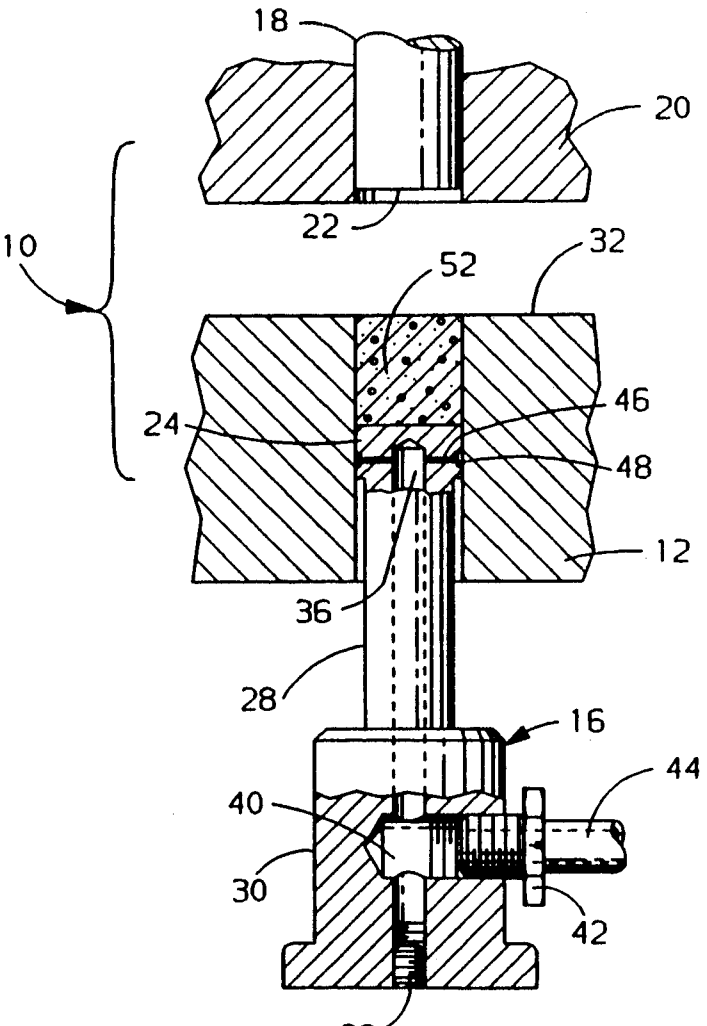

Thus, with the lower punch 16 in its down position and the upper punch 18 in its upper position and the lubricant film applied to the wall of the die cavity (FIG. 1*b*), the cavity 14 is now ready to receive the powdered, rapidly solidified iron-neodymium-boron type material This material is loaded into the lower die in loose particulate form. It is dropped into the die from a hopper not shown, and it is measured by any suitable method into the die cavity, such as by volume. As seen in FIG. 1*c*, the powdered material 52 is now in the die, filling the cavity above the lower punch.

As soon as the particulate material 52 has been loaded into the die, the upper punch is lowered to close the die cavity. The upper and lower punches are then loaded to consolidate the powder into the green compact 34. A compaction pressure of about 25 tons/in$^2$ is employed in this example. FIG. 1*d* illustrates the position of the upper and lower punches at the time that the particles have been consolidated into the green compact which is such an important aspect of the practice of our invention.

As soon as the compaction has been completed, the upper punch is raised out of the way to its upper position as depicted in FIG. 1*a*, the lower punch is raised to eject the compact from the die, the compact is removed, and the process is repeated. This cold compaction process typically requires about one to six seconds per cycle and is carried out at ambient conditions. The cold compact may have a trace of Teflon powder on its outer surfaces, it may have a trace of the vehicle, but the composition of the vehicle is such that it does not adversely affect the permanent magnet properties of the iron-neodymium type material.

This completes the first step of our process. It is important to note that the use of the lubricant on the die wall only and the selection of the vehicle for application of the solid lubricant, preferably Teflon, is very important in the formation of a green compact of suitable density in a practical amount of time and of a material that will not degrade its properties upon aging.

The green compact of the iron-neodymium type particulate material serves as a preform for the hot pressing step which is to follow. These preforms are coated with a die release type lubricant preparatory to the hot pressing operation. A suitable die release lubricant for this practice is a suspension of boron nitride powder in an isopropyl alcohol carrier. This material is sprayed onto the compacts by any suitable method, and the compacts are dried to evaporate the isopropyl alcohol and leave a coating of the finely divided boron nitride particles on the outer surface of the preforms.

While the lubricant may be applied by any suitable application equipment such as conventional spray painting equipment, we have found it useful to place the preforms in trays with a plurality of cylindrical cavities sized to receive about half of the preform body. A tray of several of the preforms can thus be sprayed to coat them on one half, the tray is inverted into another like tray that receives the coated portion of the preform, and the other half of the preform is sprayed with a lubricant material.

The cold compact preforms have a density of approximately 70 percent of the density of a fully consolidated iron-neodymium-boron type composition that is useful as a permanent magnet material. While much of the porosity of the loose powder has been removed by the cold compaction process, the preform is still porous and susceptible to oxidation, if not burning, when heated to an elevated temperature in air. However, one of the advantages of the use of our preform is that the material is dense enough to be fairly rapidly heated to a hot pressing temperature. The practice of the hot pressing step of our method will illustrate how we accomplish the hot pressing in a rapid compaction cycle while protecting the preform body from oxidation when it is at its hot working temperature.

We use an open-to-the-air hot press for the practice of the hot pressing step of our method. While presumably a single press could be used in sequence to do both the cold compaction and the hot pressing steps of our method, we prefer the use of separate presses because one needs to be adapted for heating of the workpiece in the die and punches. However, both presses may be open-to-the-air presses.

Referring now to FIGS. 2*a* through 2*d*, we will describe the operation of the hot pressing practice in our method. The totality of the hot press 100 is not shown but just the die region 102 with the lower punch 104 and the upper punch 106 and the upper punch carrier 108. The upper punch 106 is heated via its guide 110 by a suitable heating means such as a resistance heater 112. The die 114 is heated by resistance heater 116 or other suitable heater and the lower punch 104 is heated through the die 114. Thus, the die and upper and lower punches are capable of being heated so as to raise this region of the press to a suitable hot pressing temperature.

Figure 2B:
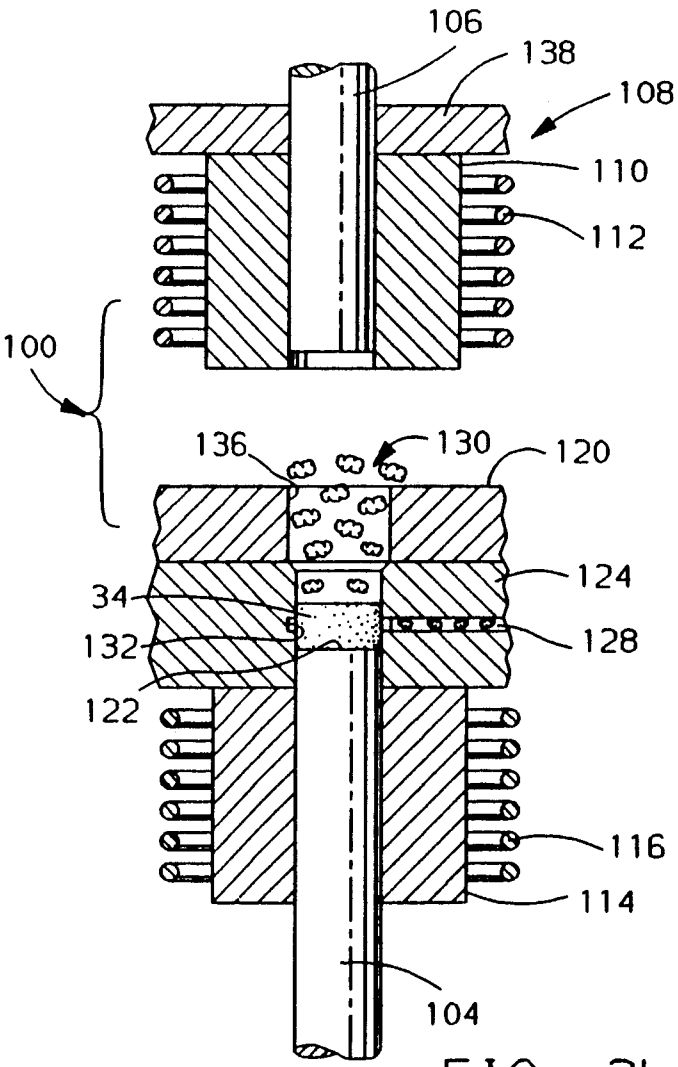
FIGS. 2*a* through 2*d* are schematic views, partly in section, of an open-to-the-air hot press illustrating the sequence of steps involved in the hot pressing of a cold compact, including the preferred practice for flooding the hot die cavity with dry inert gas.
Figure 2A:
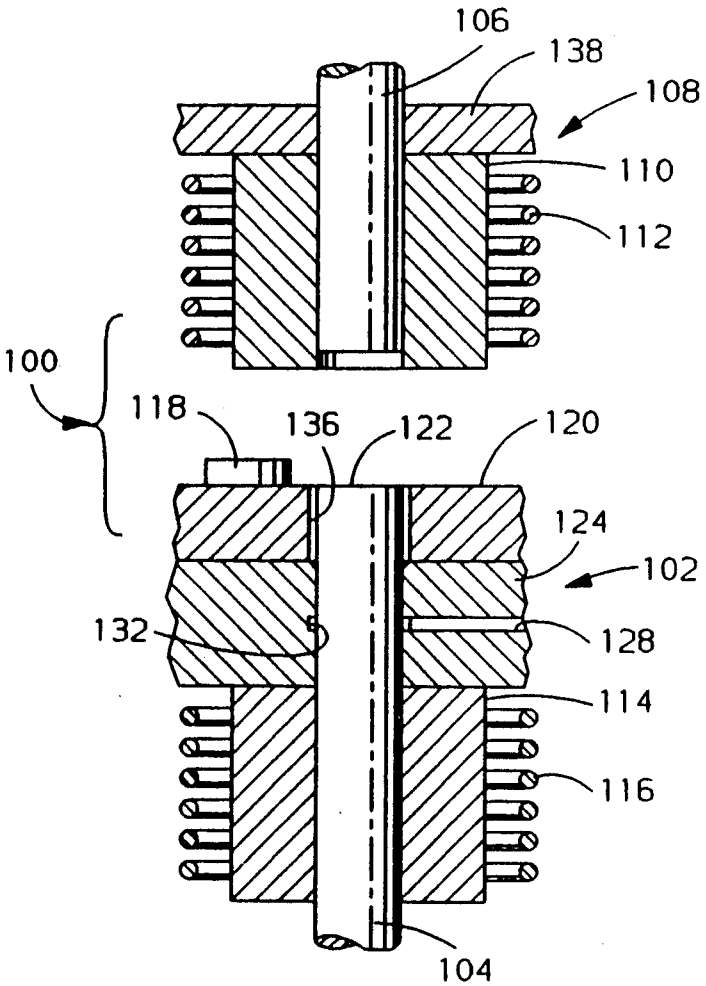

FIG. 2*a* illustrates the position of the hot press 100 elements at the completion of a hot pressing cycle. A fully consolidated permanent magnet part 118 has just been ejected by action of the lower punch 104 from the die 114 and rests upon the die stack cover 120, having been pushed off the flat face 122 of lower punch 104 by a robot arm or a rake (not shown). Referring to the lower half of this operative portion of the hot press 100, the die stack 120 is carried on a manifold member 124 adapted for the delivery of argon or other suitable dry inert gas to the die cavity. Below the manifold member 124 is the heated die 114. Die 114 defines a circular, right cylindrical die cavity 126 (FIG. 2*c*) sized to receive the green compact 34.

Since these press members are going to be operated at a hot pressing temperature, suitably about 870° C. for heating and hot pressing, reactive rare earth element containing compact bodies (e.g., compact 34), they must be formed of suitable temperature and reaction-resistive materials. The die 114 is preferably formed of nickel aluminide. The upper 106 and lower 104 punch members are suitably formed of Inconel 718 or other suitable high temperature material.

In FIG. 2*a*, the lower punch 104 is seen at its uppermost position. The manifold member 124 comprises a duct 128 for the delivery of dry argon (illustrated as gas clouds 130 in FIGS. 2*b* and 2*c*) to the die cavity 126 and an annular ring 132 at the cavity portion 134 of the manifold 124 that is sized to receive the lower punch 104. The die stack cover 120 also has a round cylindrical opening 136 to receive alternately the upper punch 106 and the lower punch 104. It is slightly oversized with respect to the punches to permit and accommodate the flow of argon gas around the lower punch 104 and out the die stack member 120 for purging of the whole die cavity of oxygen (see FIGS. 2*b* and 2*c*).

Also seen in FIG. 2*a* is the upper punch 106 in its uppermost retracted position. The punch 106 is carried by a suitable press support member 138 and a punch carrier member 110.

Figure 2D:
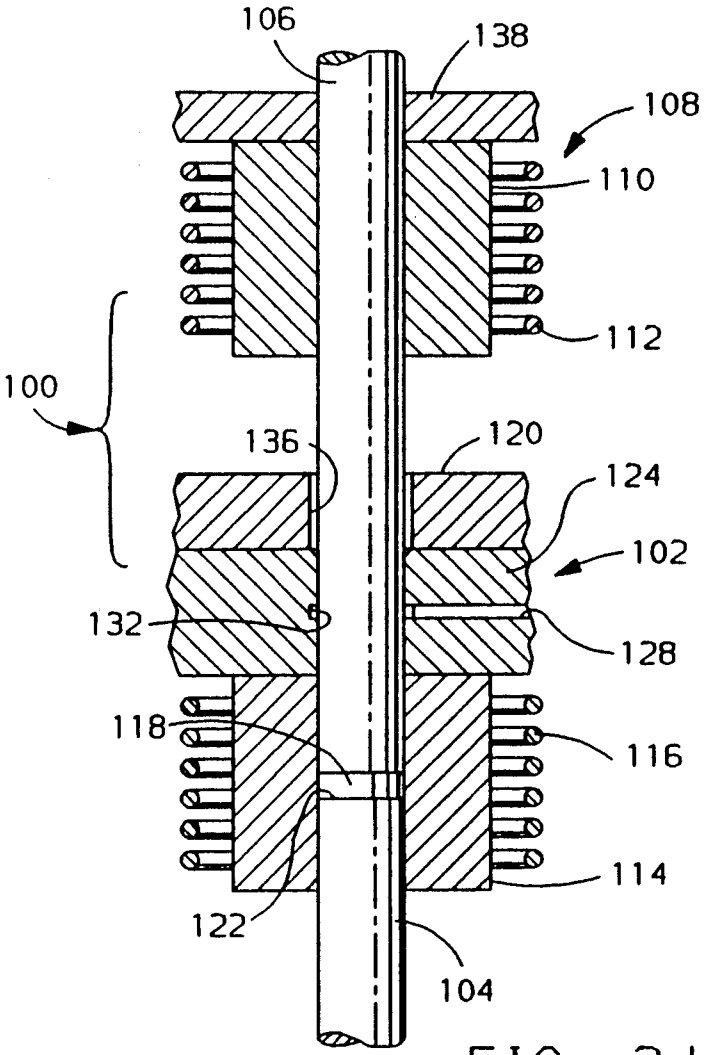
Figure 2C:
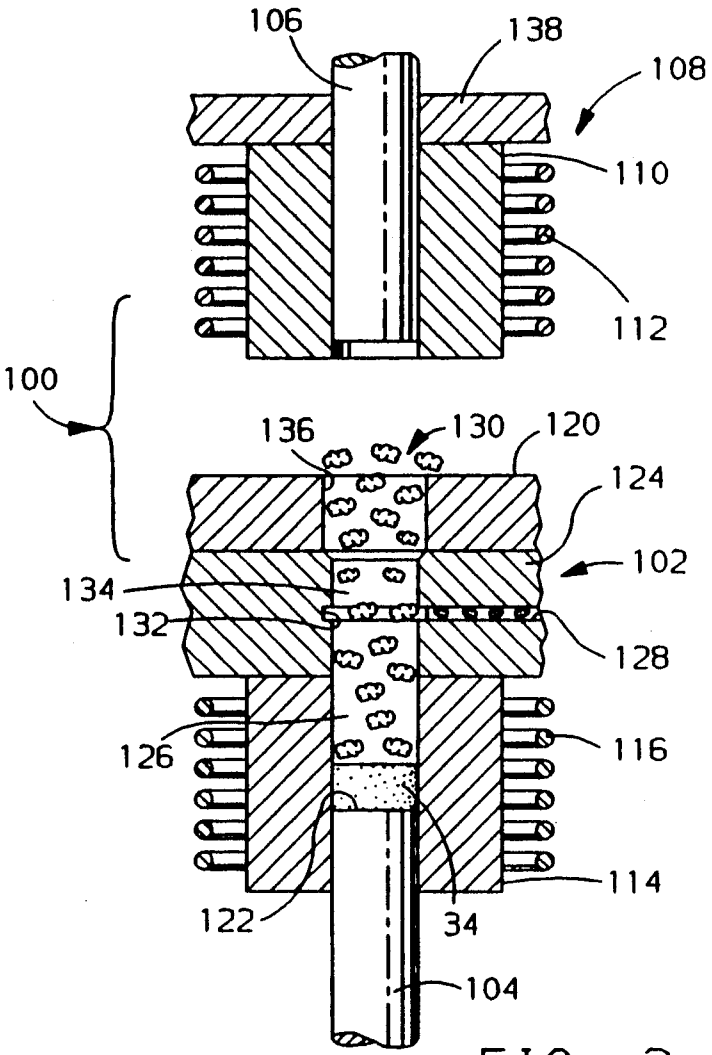

We prefer that argon gas be continually delivered into the manifold body 124. Thus, a small stream of argon is flowing around the lower punch 104, even in its upper position shown in FIG. 2*a*. The lower punch 104 is then dropped to a position just below the argon delivery passage 128. Argon continues to flow, purging the cavity of oxygen that may have been inducted by the down stroke of the lower punch 104. A cold compact preform member 34 is dropped by a suitable automated arm (not shown) into the manifold cavity 134 as shown in FIG. 2*b*. The flow of argon continues as indicated by the clouds 130 of the gas schematically depicted in FIGS. 2*b* and 2*c*. The lower punch 104 is then dropped further, the compact 34 riding on the lower punch 104 down into the cavity 126 of the nickel aluminide die body 114. Argon continues to flow into the manifold cavity 134 and die cavity 126 to purge them of oxygen and moisture. The hot upper punch 106 is then lowered as illustrated in FIG. 2*d* into a pressing position with the lower punch 104 and the compact 34. It is in this position, pressed between the hot punches and the heated dies, that most of the heat is transferred to the compact 34 to raise its temperature above about 700° C. The machine load on the punches is increased, and they exert a pressure of about six tons/in$^2$ on the compact. It is consolidated in the hot die cavity into a fully densified body 118 of about 7.4 to 7.6 grams per cubic centimeter, depending upon alloy composition. As soon as the compaction process has been completed as depicted in FIG. 2*d*, the upper punch is raised, the lower punch follows carrying the compacted body up to the top level of the die stack cover as depicted in FIG. 2*a*, and the fully densified body 118 is pushed away from the die system 102.

There are several features of this process which we believe contribute substantially to the rapid hot pressing operation. The whole procedure of purging the die with argon, loading the die cavity with a cold formed precursor, heating the precursor by heat transfer from the heated die and punches, pressing the precursor into a fully densified body, and the ejection of the hot pressed body from the die all takes place in a period of about 25 to 90 seconds, depending upon part size (weight).

The rapidity of this operation is facilitated both by the continual purging of the die from a manifold that surrounds the punch and continues to drive the oxygen from the die and the use of the cold compacted preform which, although not fully densified and susceptible to oxidation, is dense enough to be rapidly heated in the hot die. Note that it is preferred not to heat the preform before it is introduced into the die because this would require special protection of the preform before it enters the die in order to prevent oxidation.

The hot pressed permanent magnet bodies produced as described above require little additional machining before use. It may be necessary to remove some flash, but very little grinding or other machining is required. The permanent magnet bodies upon magnetization display a maximum energy product of about 15 megaGaussOersted depending upon composition. They are fully densified, and they display some magnetic anisotropy although they are substantially isotropic in their magnetic properties. They are useful as is in many permanent magnet applications. The small cylindrical magnets 118 that were illustrated in FIGS. 2*a* and 2*d* during the hot pressing operation are utilized, for example, in magnetoresistive speed sensors in antilock brake systems and the like.

In many applications it is desired to further hot work fully densified magnetic bodies by hot work deforming them to produce a flow in the metallic material that aligns the 2-14-1 type grains and provides a substantially anisotropic magnetic body. Such bodies may display maximum energy products of the order of 30 to 45 megaGaussOersted depending upon composition and degree of hot working.

One suitable way for the additional hot working of hot pressed bodies such as those prepared by the process depicted in FIGS. 2*a* through 2*d* is a die upsetting operation. In the hot die upsetting operation, a fully densified body is placed into a heated die that is larger than the body itself so that when the punch is pressed, the body flows laterally and is compressed in height to assume the shape of the cavity defined between the punches and by the die body. Utilizing suitably shaped punches, suitably shaped hot pressed bodies and a die cavity of suitable configuration, considerable deformation of a fully densified body can be obtained to achieve nearly complete alignment of the 2-14-1 grains in the body. The resulting product as stated above is a very strong permanent magnet.

In accordance with our invention, the fully densified bodies of the second step of our process may be subjected to any suitable form of hot working such as die upsetting, forging, hot rolling and the like. In general, since we are now going to undertake deformation of the body itself, it may be useful to lubricate the body with a forging or hot working type lubricant such as graphite powder.

Since the starting point workpiece for the hot upsetting or other hot working operation is itself a fully densified body, it is suitable to preheat the body in open air to some extent before it enters the hot working equipment. Otherwise, the body can be added in an unheated condition to an open air, hot die cavity such as that depicted in the hot pressing operation.

Thus, in conclusion and in summary, our invention comprises at least two steps and optionally a third step. The first step of our method is a cold compaction process in which rapidly solidified particulate material is consolidated into a cold compact in a solid lubricant lined die cavity. Such solid lubricant may also be applied to cores if they are used. The solid lubricant is selected so as not to contaminate the cold compact body but to facilitate its compaction and removal from the die.

In the second step of our process, the cold compact is introduced into a dry inert gas-purged heated die cavity and rapidly compressed at a suitable hot working temperature into a fully densified body. The resultant body is useful as a permanent magnet and for many applications the two steps produce a wholly useful product. Where it is desired to achieve alignment of the 2-14-1 grains in the body, the fully densified body may be further hot worked to form an anisotropic permanent magnet.

While our practice has been described in terms of a few specific embodiments thereof, it will be appreciated that other forms of our invention could readily be adapted by those skilled in the art. Accordingly, the scope of our invention is to be considered limited only by the following claims.

The embodiments of the invention in which an exclusive property or privilege is claimed are defined as follows:

1. A method of consolidating a rare earth element-containing powder alloy of B precursor composition into a fully densified permanent magnet body utilizing two pressing steps in at least one open-to-the-air press of the type comprising a die member defining a material-receiving die cavity with a die wall defining a predetermined cross-sectional configuration and opposing pressing members, at least one of which is adapted to move reciprocally in the die cavity to compress material placed there, said method comprising applying a solid lubricant film to the cavity-defining wall of a die which is at substantially ambient temperature, charging a predetermined quantity of a lubricant- and binder-free rare earth element-containing metal alloy powder to the lubricated cavity, consolidating the powder in the die by pressing member action at ambient temperature to form a green compact of generally self-sustaining strength and a density of about five grams per cubic centimeter or higher, flooding a die cavity of a heated die press with a dry inert gas to displace air from the cavity, the die being maintained at an elevated temperature for hot pressing the compact and the cavity being configured to receive a said green compact, placing a green compact in the heated, inert gas-containing die cavity while continuing the flooding of the cavity and pressing the green compact to a substantially fully densified body by pressing member action as the body is being heated to a hot working temperature, and removing the hot, fully dense body from the cavity into ambient air.

2. A method as recited in claim 1 in which the solid lubricant is applied to the die wall of the ambient temperature press by spraying solid lubricant particles dispersed in a volatile nonflammable vehicle through a duct in a said movable pressing member.

3. A method of consolidating a rare earth element-containing powder alloy of $RE_2TM_{14}B$ precursor composition into a fully densified permanent magnet body ,/ utilizing two pressing steps in at least one open-to-the-air press of the type comprising a die member defining a material-receiving die cavity with a die wall defining a predetermined cross-sectional configuration and upper and lower opposing punches adapted to move reciprocally in the die cavity to compress material placed there, said method comprising applying a solid lubricant film to the cavity-defining wall of a die which is at substantially ambient temperature, charging a predetermined quantity of a lubricant- and binder-free rare earth element-containing metal alloy powder to the lubricated cavity onto the lower punch, consolidating the powder in the die by punch action at ambient temperature to form a green compact of generally self-sustaining strength and a density of about five grams per cubic centimeter or higher, flooding a die cavity of a heated die press with a dry inert gas to displace air from the cavity, the die being maintained at an elevated temperature for hot pressing the compact and the cavity being configured to receive a said green compact, placing a green compact in the heated, inert gas-containing die cavity while continuing the flooding of the cavity and pressing the green compact to a substantially fully densified body by punch action as the body is being heated to a hot working temperature, and removing the hot, fully dense body from the cavity into ambient air.

4. A method as recited in claim 3 in which the solid lubricant is applied to the die wall of the ambient temperature press by spraying solid lubricant particles dispersed in a volatile nonflammable vehicle through a duct in a said movable pressing member.

5. A method as recited in claim 3 wherein the hot pressing operation is conducted by raising the lower punch to a hot pressed part eject position, and introducing dry inert gas into the cavity while dropping the lower punch to a workpiece-receiving position and continuing to flood the growing cavity with dry gas.

6. A method as recited in claim 3 wherein the fully densified body is subsequently introduced into a heated die cavity that is larger in cross sectional area than the hot pressed body and the body is heated to a die upsetting temperature and deformed by die upsetting to form a fully densified anisotropic magnet body.

* * * * *